United States Patent [19]

Feiss

[11] 4,439,963

[45] Apr. 3, 1984

[54] BAY WINDOW PANEL JOINT

[75] Inventor: Stephen W. Feiss, Baltimore, Md.

[73] Assignee: Fypon Inc., Stewartstown, Pa.

[21] Appl. No.: 293,008

[22] Filed: Aug. 14, 1981

[51] Int. Cl.[3] ..... E06B 1/38

[52] U.S. Cl. ..... 52/201; 52/82; 52/284

[58] Field of Search ..... 52/201, 202, 203, 127.1, 52/82, 284, 285, 588, 595, 536, 538, 539; 403/382, 13, 14, 4

[56] References Cited

U.S. PATENT DOCUMENTS

| | | | |
|---|---|---|---|
| 1,775,850 | 9/1930 | Dougherty | 52/594 X |
| 2,430,200 | 11/1947 | Wilson | 52/588 |
| 3,074,125 | 1/1963 | Miller | 52/201 |
| 3,347,048 | 10/1967 | Brown et al. | 52/595 X |
| 3,827,200 | 8/1974 | Preissler | 52/82 |
| 4,341,917 | 7/1982 | Martin | 52/588 |

*Primary Examiner*—Alfred C. Perham
*Assistant Examiner*—David J. Thomas
*Attorney, Agent, or Firm*—Scrivener, Clarke, Scrivener and Johnson

[57] ABSTRACT

The invention is directed to an improved joint between building panels, e.g. molded roof panels for prefabricated bay windows, wherein the joint consists of a slot in the edge of one of the panels. The slot has side walls, each of which is at a different angle relative to the plane of the panel. The edge of the other panel is inserted into the slot and the respective side walls thereof are engaged by one side or the other of the edge of the other panel to locate the other panel in one angular position or another with respect to the plane of the first panel.

7 Claims, 5 Drawing Figures

BAY WINDOW PANEL JOINT

This invention relates to building panels and more particularly to improved joint means for locating a pair of substantially planar building panels in edge-to-edge relationship disposed at either one of two predetermined angular positions with respect to each other.

The present invention is particularly, though not exclusively, useful for locating unitary molded roof panels for pre-fabricated bay windows of the type having a vertical glazed center panel and a pair of vertical, angularly related glazed flanker panels, which can be, for example, disposed at angles, say of 30° or 45°, relative to the plane of the building wall.

The present invention permits the location of flanker roof panels relative to a center roof panel to accomodate either 30° or 45°, or any other predetermined angles, without requiring different sets of roof panels or requiring special shaping operations to conform the roof panel joints to a particular bay window configuration.

The invention will be described as it applies to molded roof sections for pre-fabricated bay windows but it will be understood that the invention is by no means limited to such use but may be employed wherever it is desired to locate a pair of planar panels in edge-to-edge relationship at either of two predetermined angles with respect to each other.

The broad object, therefore, of the invention is to provide joint means for locating a pair of building panels in edge-to-edge relationship in one of two predetermined angular positions relative to each other.

Another object of the invention is to provide molded roof panels incorporating the joint of the invention.

The invention will now be described in detail with reference to the accompanying drawings wherein.

Figure 1:
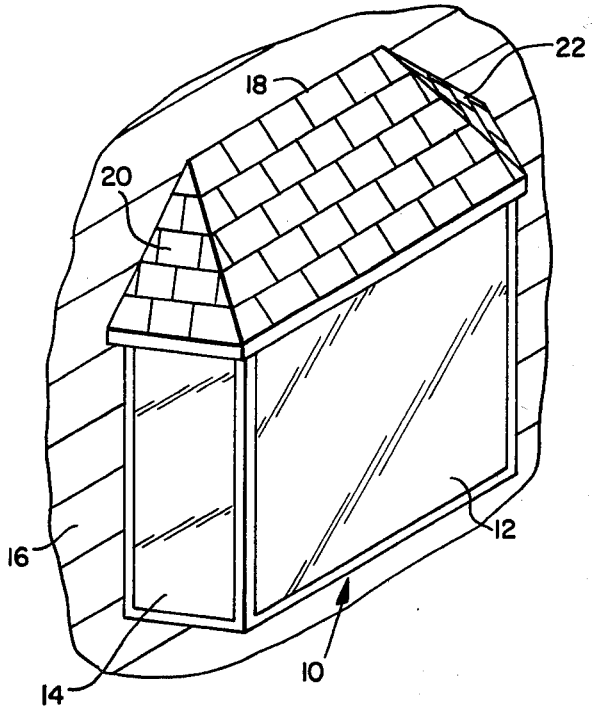
FIG. 1 is a perspective view showing a representative bay window including roof panels.
Figure 2:
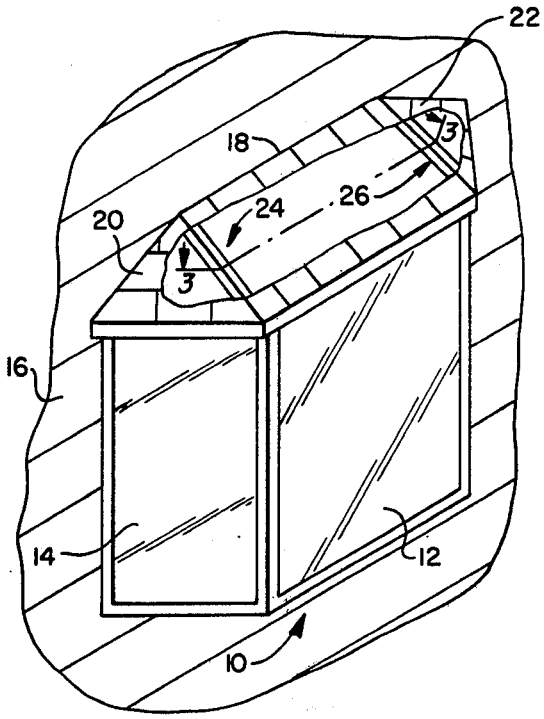
FIG. 2 is a view similar to FIG. 1 but showing portions of the roof panels broken away to expose the joints between the roof panels.
Figure 3:
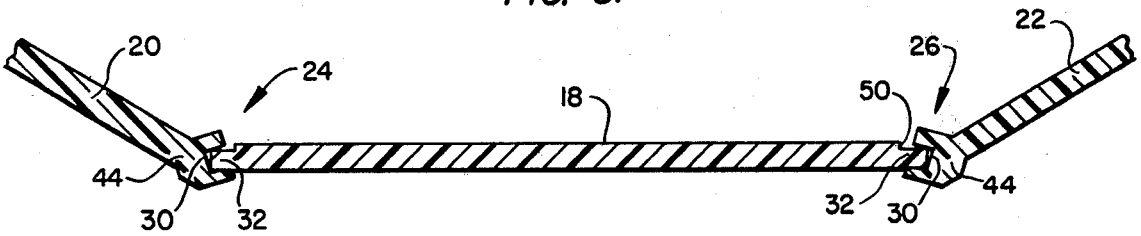
FIG. 3 is an enlarged horizontal cross-sectional view taken substantially on the line 3—3 of FIG. 2.

Referring now to the drawings 10 refers broadly to a bay window comprising a vertical glazed center panel 12 having a pair of glazed flanker panels 14 (only one being visible) arranged at a predetermined angle relative to a building wall 16. The angle of the flanker panels relative to the wall 16 is typically either 30° or 45° and there are now on the market pre-fabricated bay windows comprising the three panels only, it being left to the installer to provide the bay window roof, which normally would be constructed in a conventional manner. Instead of conventional roof construction, however, it has been discovered that there is a market for roofs formed of unitary molded plastic panels which may be joined together edge-to-edge in predetermined angular relationships conforming to the angles of the vertical bay window panels. The present invention is concerned with the joint between two panels and though described in connection with molded panels for bay window roofs, the invention is by no means limited to such use since it is clearly applicable to any use where two panels are to be located in alternative angular positions with respect to each other.

Where the roof of a bay window is composed of molded plastic panels, these may comprise a central panel 18 and a pair of flanker panels 20, 22 which are joined at 24, 26 in predetermined angular relation corresponding to the angles between the bay window panels. With respect to FIGS. 3, 4 and 5, the joints 24, 26 are defined by crescent shaped slots 30 which are preferably formed along the corresponding side edges of the flanker panels 20, 22 as shown in FIG. 3. As can be seen, the slots 30 open in the direction of the edges 32 of the center panel 18 and each has an inner wall 34 (FIGS. 4 and 5) and first and second opposed side walls 36, 38. The side wall 36 of the slot is arranged at a first predetermined obtuse angle, say 135° relative to the plane of the panel 20, as shown by the arrow in FIG. 4, and the second side wall is arranged at a second obtuse angle greater than the first, say 150°, as shown by the arrow in FIG. 5.

Figure 4:
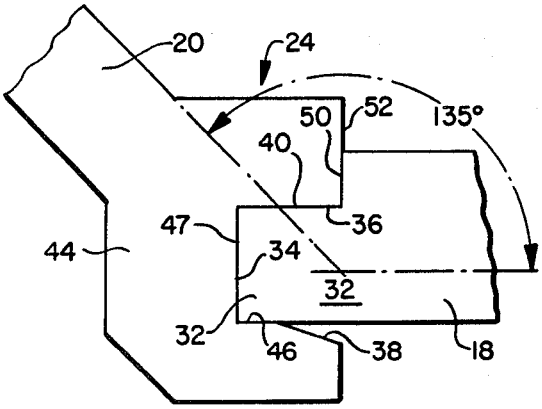
FIG. 4 is an enlarged broken detailed view of the joint between two adjacent panels showing said panels in one relative angular position.
Figure 5:
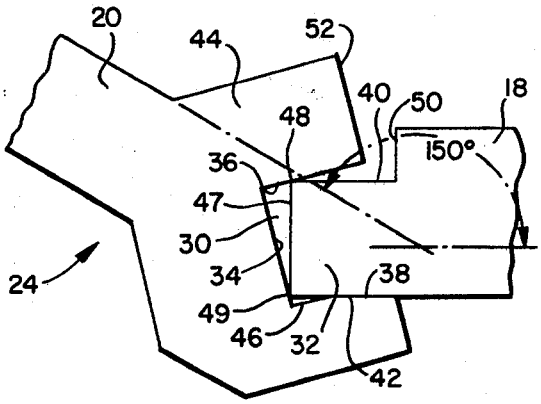
FIG. 5 is a view similar to FIG. 4 but showing the panels in a second relative angular position.

The first wall 36 of the slot is adapted to engage one side part 40 of the edge 32 of the center panel 18 to locate the flanker panel at the first predetermined angle, say 135°, relative to the central panel, as shown in FIG. 4, and the second wall 38 of the slot 30 is adapted to be engaged by the opposite side part 42 of the edge 32 of the flanker panel to locate it at the second predetermined angle, say 150°, relative to the central panel as shown in FIG. 5.

Where the panels are formed of molded components, the slots 30 are preferably molded in integral enlarged edge portions 44 of the flanker panel in order to accomodate a central panel whose dimensions between its side edges may vary over a wide range to accomodate different sized bay windows. Preferably the inner portion 46 of the slot side wall 38 adjacent the bottom wall 34 of the slot is parallel to the opposite wall 36, the spacing between the parallel slot portions being substantially equal to the thickness of the center panel edge 32 so that the latter can be snugly received between the parallel portions of the slot when the corresponding edge portion 40 of the panel 18 engages the slot side wall 36 as in FIG. 4, and the square end face 47 of the panel abuts the inner wall 34 of the slot which wall is normal to the parallel portions of the slot. When the other slot side wall 38 engages the panel 18 as in FIG. 5 the dimensions of the slot relative to the panel thickness are preferably selected so that the upper corner 48 of the edge of panel 18 engages the wall 36 of the slot and the lower corner 49 engages the inner wall 34.

The edges of the central panel may be rabbeted as shown to provide a shoulder 50 which abuts an outer face 52 of the slotted enlargement 44 when the flanker panel is in the position of FIG. 4.

In use as roof panels, the center panel 18 is first positioned on the previously installed pre-fabricated bay window panel. After fixing in place, including embedment in adhesive mastic, the joint grooves 30 of the flanker panels are filled with mastic and pressed into the edges of the center panel. Ideally, the angles between the central and flanker panels will conform to the angles, usually 30° or 45° of the flanker window panels 14 relative to the building wall 16, but if there should be slight deviation in these angles the arrangement of the invention permits variation in the angles of the roof panels to conform with such deviation in the window panel angles, the mastic permitting slight accomodation while supporting the flanker roof panels against movement with respect to the center panel.

Though the invention has been described in connection with molded roof panels for pre-fabricated bay windows, it should be clear that the invention is by no means limited to such use but may be used in a variety of other fields. Further, the invention is susceptible of a variety of changes without departing from the scope and spirit of the appended claims.

What is claimed is:

1. A bay window roof comprising a substantially planar center section panel and a pair of substantially planar flanker section panels, each of said panels being formed of unitary molded plastic material, and means for locating each one of said pair of flanker section panels with a side edge thereof abutting a corresponding side edge of said center section panel with said panels disposed at one of two predetermined obtuse angular positions with respect to each other, said locating means comprising a crescent shaped slot along the edge of one of said flanker and center section panels opening in the direction of the edge of the other of said panels, said slot having an inner wall having opposed edges and first and second spaced opposed side walls, the first of said walls extending from one of said edges of said inner wall at a first predetermined obtuse angle relative to the plane of said one panel and the second of said side walls extending from the otherof said edges of said inner wall and having at least a portion thereof at a second predetermined obtuse angle greater than said first obtuse angle relative to the plane of said one panel, the first wall of said slot being selectively abuttingly engageable in parallel relationship by one side part of the edge of said other panel to locate said other panel at said first predetermined obtuse angle relative to said one panel, and the second side wall of said slot which is at a greater obtuse angle from the plane of said one panel being selectively abuttingly engageable in parallel relationship by the opposite side part of the edge of said other panel to locate said other panel at said second predetermined obtuse angle relative to the plane of said one panel.

2. The locating means of claim 1 wherein an inner portion of said second side wall of said slot adjacent the corresponding edge of said inner wall of said slot is parallel to the other slot side wall.

3. The locating means of claim 1 wherein the first predetermined angle is 135° and the second predetermined angle is 150°.

4. The locating means of claim 1 wherein said slot is formed in an enlarged portion along the edge of said one panel.

5. The locating means of claim 2 wherein the edge of said other panel received in said slot has a thickness substantially equal to the width of said inner wall between said first side wall and the portion parallel thereto of said second side wall, and said edge of said other panel is adapted to be received between the parallel parts of said slot side walls when said edge is inserted into said slot so as to engage said first side wall.

6. The locating means of claim 1 wherein an edge of each of said flanker section panels is provided with said crescent shaped slot to receive the corresponding edges of said center panel.

7. The locating means of claim 5 wherein the inner wall of said slot is normal to the parallel portions of said slot and the inner face of the edge of said other panel is square and adapted to abut the inner wall of said slot when said edge is received between and parallel to the parallel portions of said slot, the dimension of said slot being selected relative to the thickness of the edge of said other panel that when the portion which is at said greater obtuse angle of said second wall of said slot is engaged by said opposite side part of said edge, the corner of said edge adjacent the first wall of said slot engages that wall and the opposite corner engages the inner wall of said slot.

* * * * *